US008579406B2

(12) United States Patent
Buchar et al.

(10) Patent No.: US 8,579,406 B2
(45) Date of Patent: Nov. 12, 2013

(54) REAL TIME BLEED-THOUGH DETECTION FOR CONTINUOUS WEB PRINTERS

(75) Inventors: Wayne A. Buchar, Bloomfield, NY (US); Brendan C. Casey, Webster, NY (US); Joseph A. Mastrandrea, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 1059 days.

(21) Appl. No.: 12/560,507

(22) Filed: Sep. 16, 2009

(65) Prior Publication Data

US 2011/0063359 A1 Mar. 17, 2011

(51) Int. Cl.
*B41J 29/393* (2006.01)

(52) U.S. Cl.
USPC ..... 347/19; 347/102; 347/104

(58) Field of Classification Search
CPC ..... B41J 29/393; B41J 2/17546; B41J 2/0458
USPC ..... 347/19, 88, 99, 102, 104, 212
See application file for complete search history.

(56) References Cited

U.S. PATENT DOCUMENTS

| | | | | |
|---|---|---|---|---|
| 4,340,893 | A * | 7/1982 | Ort | 347/102 |
| 6,088,565 | A * | 7/2000 | Jia et al. | 399/302 |
| 6,300,968 | B1 * | 10/2001 | Kerxhalli et al. | 347/116 |
| 6,585,341 | B1 * | 7/2003 | Walker et al. | 347/14 |
| 2005/0240366 | A1 | 10/2005 | Mestha et al. | |
| 2007/0086799 | A1 | 4/2007 | Burry et al. | |
| 2009/0040261 | A1 | 2/2009 | Zhang et al. | |

* cited by examiner

*Primary Examiner* — Ryan Lepisto
*Assistant Examiner* — Erin Chiem
(74) *Attorney, Agent, or Firm* — Maginot, Moore & Beck, LLP

(57) ABSTRACT

An imaging device includes a substantially continuous web of media; a web transport system configured to transport the continuous web along a web path; and a print station positioned along the web path and configured to apply ink to a first side of the continuous web to form images thereon. An image sensor is positioned downstream from the print station along the web path to scan a second side of the continuous web opposite from the first side. The image sensor is configured to generate a reflectance signal indicative of a reflectance of light from the second side of the continuous web. A controller is operably coupled to receive the reflectance signal from the image sensor, and to adjust at least one print process parameter based on the reflectance signal while the imaging device is performing print operations.

18 Claims, 2 Drawing Sheets

REAL TIME BLEED-THOUGH DETECTION FOR CONTINUOUS WEB PRINTERS

TECHNICAL FIELD

The present disclosure relates to ink-jet printing, particularly involving phase-change inks printing on a substantially continuous web.

BACKGROUND

In general, ink jet printing machines or printers include at least one printhead that ejects drops or jets of liquid ink onto a recording or image forming media. A phase change ink jet printer employs phase change inks that are in the solid phase at ambient temperature, but transition to a liquid phase at an elevated temperature. The molten ink can then be ejected onto a printing media by a printhead directly onto an image receiving substrate, or indirectly onto an intermediate imaging member before the image is transferred to an image receiving substrate. Once the ejected ink is on the image receiving substrate, the ink droplets quickly solidify to form an image.

In both the direct and offset printing architecture, images may be formed on a continuous media web. In a web printer, a continuous supply of media, typically provided in a media roll, is conveyed by a plurality of rollers that are arranged to guide the media web through a print zone where a plurality of printheads are positioned to deposit ink onto the web to form images. Beyond the print zone, the media web is gripped and pulled by mechanical structures so a portion of the media web continuously moves through the print zone. Tension bars or rollers may be placed in the feed path of the moving web to remove slack from the web so it remains taut without breaking.

In continuous-web direct to paper printing, a fixing assembly is used after the ink is jetted onto the web to fix the ink to the web. The fixing assembly used depends on the type of ink. For example, when using melted phase change ink to form images, the fixing assembly may include a spreader configured to apply pressure to the ink and web to spread the ink on the web. The function of the spreader is to transform a pattern of ink droplets deposited onto a web and smear them out to make a more uniform and continuous layer. The spreader uses pressure and/or heat to reduce the height of the ink droplets and fill the spaces between adjacent drops. When UV curable inks are used, the fixing assembly may include one or more curing lamps to cure the UV ink onto the web.

Sometimes the ink deposited onto the web may bleed into the web before the ink is fixed to the web. For example, a liquid or molten uncured ink may bleed into the fibers of a paper substrate and become at least partially visible from the backside of the substrate. This problem is known in the art as showthrough or bleed-through, and is generally known to exist for any type of liquid ink deposited on a porous substrate. This issue is more pronounced in inks of low viscosity, such as ink jet inks, while higher viscosity inks are less susceptible to this problem. Specifically, showthrough is a measure of how colorized an ink makes the backside of the substrate.

In previously known systems, bleed-through detection on a temperature sensitive printing system (i.e. ink jet) was only able to be detected visually, after the image had been printed. In addition, the ability to correct or remediate the factors that may be causing image bleed-through the use of a real-time detection mechanisms while actively printing has been limited or non-existent. For example, if bleed-through was visually detected for a given media type, the print process critical parameters would be manually adjusted prior to printing the customer job and would not be adjusted during the printing of the job. Depending on the familiarity of the printer operator with the print process, the adjustment may or may not ultimately alleviate the bleed-through condition.

SUMMARY

A system has been developed that enables automatic detection and compensation of bleed-through in an imaging device without requiring user intervention to visually inspect the media or to adjust print parameters to reduce bleed-through. A bleed-through detection and compensation system for use in an imaging device includes an image sensor positioned to scan an unimaged side of a moving continuous web. The image sensor is configured to generate a reflectance signal indicative of a reflectance of light from the second side of the continuous web. The system includes a controller operably coupled to receive the reflectance signal from the image sensor. The controller is configured to adjust a print process parameter for the imaging device based on the reflectance signal while the imaging device is performing print operations.

In another embodiment, an imaging device includes a substantially continuous web of media; a web transport system configured to transport the continuous web along a web path; and a print station positioned along the web path and configured to apply ink to a first side of the continuous web to form images thereon. An image sensor is positioned downstream from the print station along the web path to scan a second side of the continuous web opposite from the first side. The image sensor is configured to generate a reflectance signal indicative of a reflectance of light from the second side of the continuous web. A controller is operably coupled to receive the reflectance signal from the image sensor, and to adjust at least one print process parameter based on the reflectance signal while the imaging device is performing print operations.

In yet another embodiment, a method of using an imaging device comprises transporting a substantially continuous web along a web path; depositing ink onto a first side of the continuous web to form images; scanning a second side of the web using an image sensor, and outputting a reflectance signal indicative of a reflectance of light from the second side; correlating the reflectance signal to a level of bleed-through for the continuous web; adjusting at least one print process parameter based on the level of bleed-through indicated by the reflectance signal; and applying at least one of pressure and heat to the images on the continuous web downstream from the image sensor.

DETAILED DESCRIPTION

Figure 1:
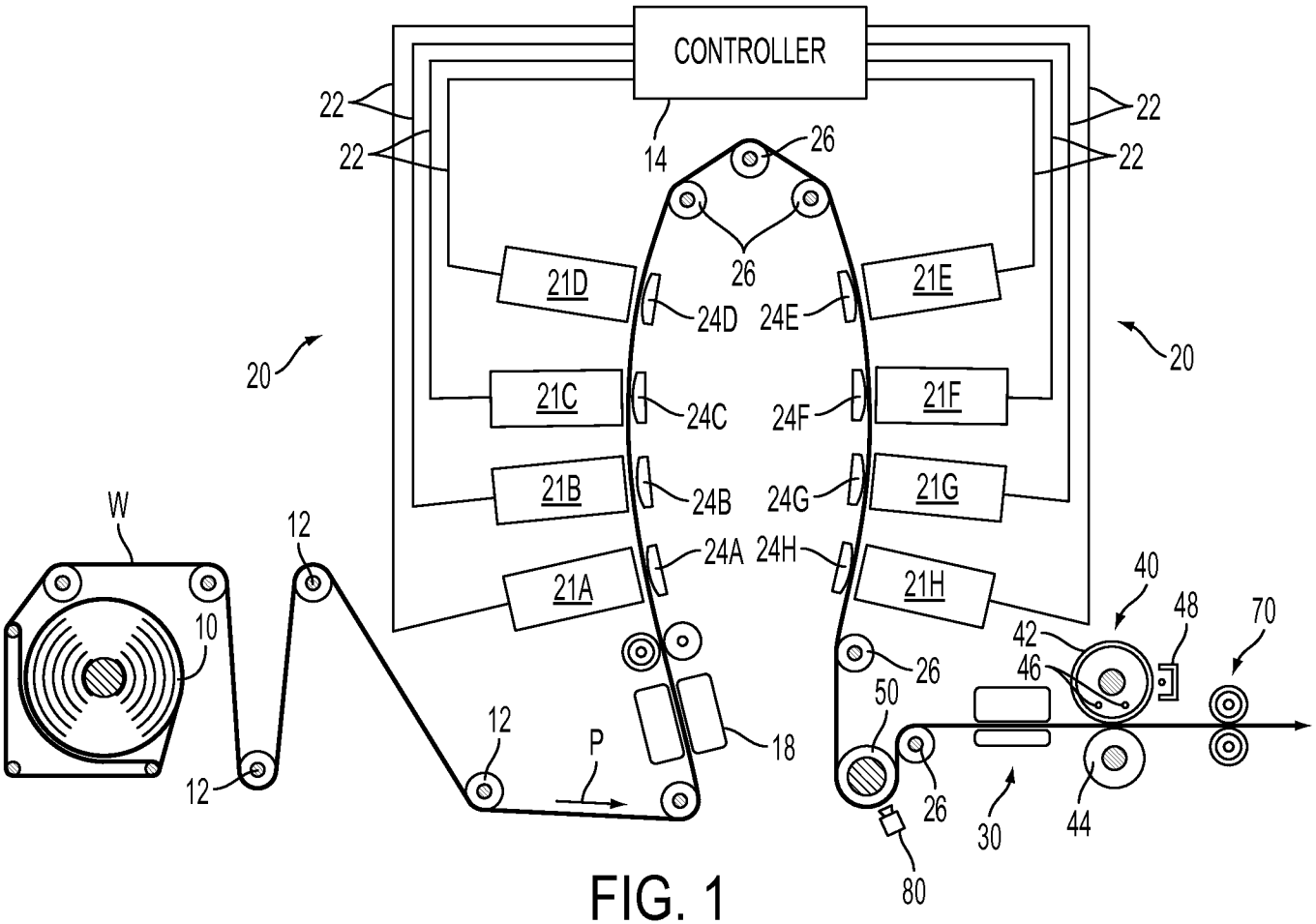
FIG. 1 is a simplified elevational view of a direct-to-sheet, continuous-web, phase-change ink printer.

For a general understanding of the present embodiments, reference is made to the drawings. In the drawings, like reference numerals have been used throughout to designate like elements.

As used herein, the term "imaging device" generally refers to a device for applying an image to print media. "Print media" may be a physical sheet of paper, plastic, or other suitable physical print media substrate for images, whether precut or web fed. The imaging device may include a variety of other components, such as finishers, paper feeders, and the like, and may be embodied as a copier, printer, or a multi-function machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. As used herein, the process direction is the direction in which an image receiving surface, e.g., media sheet or web, or intermediate transfer drum or belt, onto which the image is transferred moves through the imaging device. The cross-process direction, along the same plane as the image receiving surface, is substantially perpendicular to the process direction.

FIG. 1 is a simplified elevational view of a direct-to-sheet, continuous-web, phase-change ink printer. A web supply and handling system is configured to supply a very long (i.e., substantially continuous) web W of "substrate" (paper, plastic, or other printable material) from a spool 10. The web W may be unwound as needed, and propelled by a variety of motors, not shown. The web supply and handling system is capable of transporting the web W at a plurality of different speeds. A set of rolls 12 controls the tension of the unwinding web as the web moves through a path.

Along the path there is provided at least one preheater 18, which brings the web to an initial predetermined temperature. The preheater 18 can rely on contact, radiant, conductive, or convective heat to bring the web W to a target preheat temperature, which in one practical embodiment, is in a range of about 30° C. to about 70° C.

The web W moves through a printing station 20 including a series of printheads 21A-21H, each printhead effectively extending across the width of the web and being able to place ink of one primary color directly (i.e., without use of an intermediate or offset member) onto the moving web. Eight printheads are shown in FIG. 1 although more or fewer printheads may be used. As is generally familiar, each of the four primary-color images placed on overlapping areas on the web W combine to form color images, based on the image data sent to each printhead through image path 22 from print controller 14. In various possible embodiments, there may be provided multiple printheads for each primary color; the printheads can each be formed into a single linear array. The function of each color printhead can be divided among multiple distinct printheads located at different locations along the process direction; or the printheads or portions thereof can be mounted movably in a direction transverse to the process direction P, such as for spot-color applications.

In one embodiment, the marking media applied to the web is a "phase-change ink," by which is meant that the ink is substantially solid at room temperature and substantially liquid when initially jetted onto the web 14. Currently-common phase-change inks are typically heated to about 100° C. to 140° C., and thus in liquid phase, upon being jetted onto the web W. Generally speaking, the liquid ink cools down quickly upon hitting the web W. In alternative embodiments, however, any suitable marking material or ink may be used including, for example, ultraviolet (UV) curable ink, toner or aqueous ink.

Each printhead may have a backing member 24A-24H, typically in the form of a bar or roll, which is arranged substantially opposite the printhead on the other side of web W. Each backing member is used to position the web W so that the gap between the printhead and the sheet stays at a known, constant distance. Each backing member can be controlled to cause the adjacent portion of the web to reach a predetermined "ink-receiving" temperature, in one practical embodiment, of about 40° C. to about 60° C. In various possible embodiments, each backing member can include heating elements, cavities for the flow of liquids therethrough, etc.; alternatively, the "member" can be in the form of a flow of air or other gas against or near a portion of the web W. The combined actions of preheater 18 plus backing members 24 held to a particular target temperature effectively maintains the web W in the printing zone 20 in a predetermined temperature range of about 40° C. to 70° C.

As the partially-imaged web moves to receive inks of various colors throughout the printing station 20, the temperature of the web is maintained within a given range. Ink is jetted at a temperature typically significantly higher than the receiving web's temperature which heats the surrounding paper (or whatever substance the web W is made of). Therefore the members in contact with or near the web in zone 20 must be adjusted so that that the desired web temperature is maintained. For example, although the backing members may have an effect on the web temperature, the air temperature and air flow rate behind and in front of the web may also impact the web temperature. Accordingly, air blowers or fans may be utilized to facilitate control of the web temperature.

The web temperature is kept substantially uniform for the jetting of all inks from printheads in the printing zone 20. This uniformity is valuable for maintaining image quality, and particularly valuable for maintaining constant ink lateral spread (i.e., across the width of web W, such as perpendicular to process direction P) and constant ink penetration of the web. Depending on the thermal properties of the particular inks and the web, this web temperature uniformity may be achieved by preheating the web and using uncontrolled backer members, and/or by controlling the different backer members 24A-24H to different temperatures to keep the substrate temperature substantially constant throughout the printing station. Temperature sensors (not shown) associated with the web W may be used with a control system to achieve this purpose, as well as systems for measuring or inferring (from the image data, for example) how much ink of a given primary color from a printhead is being applied to the web W at a given time. The various backer members can be controlled individually, using input data from the printhead adjacent thereto, as well as from other printheads in the printing station.

Following the midheaters 30, along the dual path of web W, is a "spreader" 40, that applies a predetermined pressure, and in some implementations, heat, to the web W. The function of the spreader 40 is to take what are essentially isolated droplets of ink on web W and smear them out to make a continuous layer by pressure, and, in one embodiment, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rolls, such as image-side roll 42 and pressure roll 44, that apply heat and pressure to the web W. Either roll can include heat elements to bring the web W to a temperature in a range from about 35° C. to about 80° C. In embodiments of the imaging device that utilize UV curable inks, the spreader may be replaced with one or more UV curing lamps, as are known in the art, that direct ultraviolet light onto the UV curable ink that forms the images on the web.

To further control the temperature of the web and/or the ink on the web, a leveling roller and one or more midheaters may be positioned along the web path following the printing zone prior to entering the spreader. For example, as shown in FIG. 1, a leveler roller 50 may be placed along the web path between the printing zone and the spreader 40. In one embodiment, the leveler roller 50 is configured as an idler roller that derives its rotational motion from frictional engagement of the roller surface with the moving web. However, the leveler roller may be a driven in accordance with the web speed by a drive mechanism (not shown), such as a drive motor operably coupled to the roller. Suitable coupling may be through a drive belt, pulley, output shaft, gear or other conventional linkage or coupling mechanism. Tension rollers 26 may also be provided to control the carrying in angle and/or carrying out angle of the web relative to the leveler roller 50.

The leveler roller 50 is a temperature controlled, thermally conductive roller designed to operate at a temperature lower than the incoming ink and web temperatures. In one embodiment, the leveler roller is configured to operate at a target temperature of about 30° C. to about 45° C. Any suitable leveler roller operating temperature, however, may be used. The leveler roller may include a core 58 formed of a thermally conductive material, such as anodized aluminum, although the core may be made of other suitable materials, such as iron, nickel, stainless steel, and various synthetic resins. The development of thermal energy in the leveler roller 50 may be accomplished in any suitable manner. For example, the core 58 may be hollow and include one or more heating elements 64 disposed therein for generating the required thermal energy in the roller.

Midheaters may be positioned along the web path downstream from the leveler roller. Midheaters 30 can use contact, radiant, conductive, and/or convective heat to bring the web W to the target temperature. The midheaters 30 bring the ink placed on the web to a temperature suitable for desired properties when the ink on the web is sent through the spreader 40. In one embodiment, a useful range for a target temperature for the midheater is about 35° C. to about 80° C. The midheaters 30 have the effect of equalizing the ink and substrate temperatures to within about 15° C. of each other. Lower ink temperature gives less line spread while higher ink temperature causes show-through (visibility of the image from the other side of the print). The midheaters 30 adjust substrate and ink temperatures to 0° C. to 20° C. above the temperature of the spreader.

Following the spreader 40, the printer may include a "glosser" 70, whose function is to change the gloss of the image (such a glosser can be considered an "option" in a practical implementation). The glosser 70 applies a predetermined combination of temperature and pressure to obtain a desired amount of gloss on the ink that has just been spread by spreader 40. Additionally, the glosser roll surface may have a texture that the user desires to impress on the ink surface. The glosser 70 includes two rollers (an image-side roller and a pressure roller) forming a nip through which the web W passes. In one practical embodiment, the controlled temperature at spreader 40 is about 35° C. to about 80° C. and the controlled temperature at glosser 50 is about 30° C. to about 70° C. Typical pressure against the web W for the roll pairs in each of the spreader 40 and the glosser may be about 500 to about 2000 psi. Adjustment of the pressure is advisable with ink formulations that are soft enough that high pressure would cause excessive spreading.

Following passage through the spreader 40 (and glosser if implemented) the printed web can be imaged on the other side, and then cut into pages, such as for binding (not shown). Although printing on a substantially continuous web is shown in the embodiment, the system described above can be applied to a cut-sheet system as well. Different preheat, mid-heat, and spreader temperature setpoints can be selected for different types and weights of web media.

Operation and control of the various subsystems, components and functions of the device 11 are performed with the aid of a controller 14. The controller 14 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the difference minimization function, described above. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

Solid ink prints generated by an imaging device may be affected by a print defect known as bleed-through that results from an un-optimized print process depositing and curing temperature sensitive ink onto a substrate. The ink permeates into the paper fiber through capillary action resulting in subtle image artifacts that show through, or bleed-through, to the opposite side of the substrate, i.e., the unimaged or unprinted side of the substrate. There are many causes of bleed-through ranging from incorrect temperature settings on the various pre-heat, heat, and leveler rolls to excess ink being ejected from the print heads during image creation. Unless the printed product is continually monitored for this condition, the result could be unacceptable print quality and potentially undeliverable output.

Figure 2:
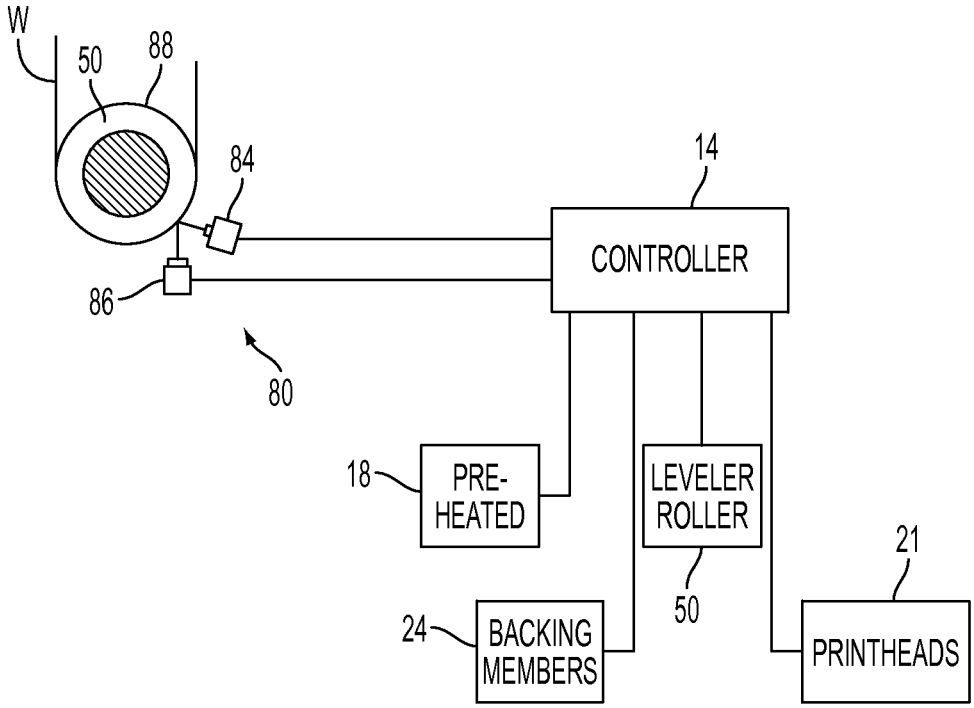
FIG. 2 is a schematic view of an embodiment of bleed-through detection and compensation system for use with the imaging device of FIG. 1.

In previously known systems, bleed-through detection on a temperature sensitive printing system (i.e. ink jet) was only able to be detected visually, after the image had been printed. In addition, the ability to correct or remediate the factors that may be causing image bleed-through the use of a real-time detection mechanisms while actively printing has been limited or non-existent. For example, if bleed-through was detected for a given media type, the print process critical parameters would need to be manually adjusted prior to printing the customer job and would remain static (open loop) for the entire run length. Depending on the familiarity of the printer operator with the print process, the adjustment may or may not ultimately alleviate the bleed-through condition. Accordingly, a system has been developed that enables bleed-through to be detected, measured, and compensated for in real time. Referring to FIGS. 1 and 2, the system utilizes an image sensor 80 positioned along the web path between the print zone and the spreader to scan the unprinted or unimaged side of the web (in real-time) in order to detect bleed-through on the web. Once bleed-through has been detected, the print process critical parameters can be adjusted to achieve an acceptable level of bleed-through while the imaging device is performing print operations without the press operator needing to detect the condition, stop the press, manually adjust the print process parameters and rerun the job.

As used herein, the imaged side or image(d) areas of the web refer to the side of the web that faces the printheads in the print zone upon which the ink, e.g., melted phase change ink, is deposited. The unprinted side or unimaged side of the web refers the side of the web opposite the imaged side which does not face the printheads in the print zone and, consequently, does not receive ink. The image sensor 80 is configured to detect, for example, the presence, intensity, and/or location of ink on the unimaged side of the web. When there is no bleed-through, there is no ink to detect on the unimaged side of the web. When there is bleed-through, ink from the imaged side of the web shows through to the unimaged side of the web that enables detection by the image sensor. Any suitable type of sensor may be utilized.

As best seen in FIG. 1, the image sensor is positioned along the web path between the print zone 20 and the spreader 40 at a location that enables the unimaged side of the web to be in the field of view of the image sensor. Any suitable location along the web path downstream from the print zone may be used. As used herein, the term "downstream" refers to the direction of movement of the web along its course of travel. The term "upstream" refers to the direction opposite to the downstream direction. The terms "lateral" and "laterally" refer to directions transverse to the travel course of the web.

In one embodiment, the image sensor 80 includes a light source 84 and a light sensor 86 (FIG. 2). The light source 84 may be a single light emitting diode (LED) that is coupled to a light pipe that conveys light generated by the LED to one or more openings in the light pipe that direct light towards the unimaged side of the web. In one embodiment, three LEDs, one that generates green light, one that generates red light, and one that generates blue light are selectively activated so only one light shines at a time to direct light through the light pipe and be directed towards the unimaged side of the web. In another embodiment, the light source is a plurality of LEDs arranged in a linear array. The LEDs in this embodiment direct light towards the unimaged side of the web. The light source 84 in this embodiment may include three linear arrays, one for each of the colors red, green, and blue. Alternatively, all of the LEDS may be arranged in a single linear array in a repeating sequence of the three colors. The LEDs of the light source are coupled to the controller 208, which selectively activates the LEDs. The controller 14 generates signals indicating which LED or LEDs to activate in the light source.

The reflected light is measured by the light sensor 86. The light sensor 86, in one embodiment, is a linear array of photosensitive devices, such as charge coupled devices (CCDs). The photosensitive devices generate an electrical signal corresponding to the intensity or amount of light received by the photosensitive devices, i.e., reflected from the unimaged side of the web. The light source and light sensor may be provided as linear arrays that extend substantially across the width of the web in the cross-process direction. Alternatively, one or more shorter linear arrays may be configured to translate across the web. For example, the linear arrays may be mounted to a movable carriage that translates across image receiving member. Other devices for moving the light sensor may also be used.

To enhance the ability of the image sensor to detect bleed-through, a background surface may be provided on an opposite side of the web relative to the image sensor so that web may be fed along the web path between the background surface and the image sensor. The background surface is a dark surface that enhances the ability of the sensor to detect bleed-through by, for example, increasing the contrast between the imaged areas and unimaged areas of the web. The background surface may be black. However, any suitable color may be utilized for the background surface. In the embodiment of FIG. 1, the image sensor is positioned to scan the unimaged side of the web as the web is wrapped on the leveler roller. In this embodiment, the leveler roller includes a black roller surface 88. Any suitable surface after the print zone, however, may be utilized for the background surface for the image sensor. For example, one or more rollers, bars, or similar devices may be added along the web path after the print zone that may be used as the background surface.

Sensor or ink parameters may be modified to improve the ability of the sensor to detect bleed-through. For example, depending on the wavelength of light being reflected from the image, the sensor 80 may be tuned to maximize signal to noise for that region of the incoming spectrum. For the case of clear UV cured gel inks, an infrared (IR) sensitizer could be added to the ink formulation allowing the IR light emitted from the light source to return back to the light sensor proportional to the amount of bleed-through being observed. The level of reflected IR light measured by the light sensor may then be fed back to the controller.

Thus, a reflectance may be detected that may be indicative of the presence and/or magnitude of bleed-through. The light sensor 86 is configured to output reflectance signals indicative of the detected reflectance to the controller 14. Based on the image sensor output, the controller 14 may be configured to determine the degree of bleed-through on the web. As explained below, once the level of bleed-through has been determined, print process parameters may be adjusted to achieve an acceptable level of bleed-through. The detection of bleed-through and adjustment of print parameters based on the bleed-through detection may occur without the operator needing to visually detect the condition, stop the printer, manually adjust the print process parameters, and rerun the job.

Examples of print process parameters that may have an affect on the level of bleed-through and that may be adjusted to reduce or prevent bleed-through include the temperature setpoints for the preheater 18, backing members (if heated), leveler roller, and midheaters. Other print parameters that may be adjusted by the controller to reduce or prevent bleed-through include the temperature of the melted phase change ink ejected by the printheads and halftone density levels generated by the printheads to print images. Any parameter that may have an affect on the level of bleed-through and that may be adjusted by the controller to reduce or prevent bleed-through is intended to be encompassed by the present disclosure.

FIG. 2 shows an embodiment of a bleed-through detection and compensation system. As depicted, the controller 14 is operably coupled to receive the reflectance signals from the light sensor 86 that are indicative of bleed-through to the unimaged side of the web. The controller 14 is also operably coupled to other devices of the imaging device, such as the preheaters 18, midheaters 30, backing members 24 (if heated), leveler roller 50, and printheads 21. Based on the input received form the image sensor 80, the controller 14 may make adjustments to one or more operating parameters of one or more of these devices in an effort to minimize or prevent bleed-through. For example, in one embodiment, the controller 14 may be configured to provide control signals to the preheaters 18 and/or backing members 24 (or to the power supplies that supply power to the preheaters or backing members) to decrease their thermal output.

The print parameter adjustments may include incrementally adjusting the control signals for one or more of the devices (18, 24, 50, 21) until the level of bleed-through detected by the sensor 80 is minimized or prevented. The sensor outputs for different levels of bleed-through may be determined empirically during testing and manufacture of the printer and saved to memory accessible by the controller 14 or may be hardwired into the controller 14. Print parameter adjustment algorithms and values may also be programmed into the controller 14. Based on the sensor 80 output, the controller 14 may be configured to generate an operating parameter adjustment value for one or more devices associated with the imaging device to prevent bleed-through. The controller may be programmed with adjustment values and may be stored in memory. Alternatively, the controller 14 may include a program or subroutine for calculating the adjustment values based on the sensor output. Minimizing or preventing bleed-through based on inline scanning of the media may require iterations. For example, after a first round of adjustments have been made to the print process parameters in accordance with the detected level of bleed-through, the process may be repeated. The level of bleed-through may be continuously detected and the print process parameters adjusted accordingly in an effort to prevent bleed-through over the life of the printer.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An imaging device comprising:

a media transport system configured to transport media along a media path;

a plurality of devices positioned along the media path, each device in the plurality being configured to generate thermal energy that is at least partially absorbed by the media being transported along the media path;

a print station positioned along the media path and configured to apply ink to a first side of the media to form images on the first side of the media;

a spreader positioned along the media path and configured to apply pressure and heat to the media after the images are formed on the first side of the media;

an image sensor positioned along the media path at a location between the print station and the spreader, the image sensor facing a second side of the media opposite from the first side of the media on which the images are formed, the image sensor being configured to direct light onto the second side of the media and generate a reflectance signal indicative of a reflectance of light from the second side of the media; and a controller operatively connected to the image sensor to receive the reflectance signal generated by the image sensor and detect a level of ink bleed-through in the media with reference to the reflectance signal, the controller being configured to adjust a print process parameter to alter the detected level of ink bleed-through without stopping print operations.

2. The imaging device of claim 1, the controller being configured to adjust a temperature of the ink applied by the print station to alter the detected level of ink bleed-through.

3. The imaging device of claim 1, the controller being operatively connected to the plurality of devices generated to generate thermal energy and the controller being configured to adjust an amount of thermal energy generated by at least one device in the plurality of devices to alter the detected level of ink bleed-through.

4. The imaging device of claim 3, the plurality of devices configured to generate thermal energy including at least a pre-heater positioned along the media path at a location prior to the print station applying ink to the first side of the media.

5. The imaging device of claim 4, the plurality of devices configured to generate thermal energy including at least one backing member positioned along the media path at a location that is opposite the print station to enable the at least one backing member to contact the second side of the media as the print station applies ink to the first side of the media.

6. The imaging device of claim 5, the plurality of devices configured to generate thermal energy including a leveler roller positioned along the media path at a location that enables the leveler roller to contact the images on the first side of the media.

7. The imaging device of claim 6 the leveler roller being opposite the image sensor to enable the image sensor to direct light onto the second surface of the media as the first side of the media passes over the leveler roller.

8. The imaging device of claim 7, the leveler roller being configured to reduce a temperature of the media passing over the leveler roller.

9. The imaging device of claim 8, the leveler roller having a black surface.

10. A bleed-through detection and compensation system for use in an imaging device, the system comprising:

an image sensor positioned along a media path in the imaging device at a location that enables a light source in the image sensor to direct light onto a second side of a moving continuous web after ink has been applied to a first side of the continuous web by a print station in the imaging device, the image sensor being configured to generate a reflectance signal indicative of an amount of light reflected from the second side of the continuous web; and a controller operatively connected to the image sensor to receive the reflectance signal generated by the image sensor, the controller being configured to detect a level of ink bleed-through with reference to the reflectance signal and to adjust a print process parameter for the imaging device to alter the detected level of ink bleed-through based on the reflectance signal without stopping print operations.

11. The system of claim 10, the controller being configured to adjust a temperature of ink applied to the first side of the continuous web to alter the detected level of ink bleed-through while the imaging device is performing print operations.

12. The system of claim 11 further comprising:

a plurality of devices, each device in the plurality of devices being configured to generate thermal energy that is at least partially absorbed by the continuous web; and the controller being further configured to adjust the thermal energy generated by at least one device in the plurality of devices to alter the detected level of ink bleed-through.

13. The system of claim 12, the plurality of devices including at least a pre-heater positioned along the media path at a location that enables the pre-heater to heat the continuous web before ink is applied to the first side of the continuous web by the print station.

14. The system of claim 13, the plurality of devices including at least one backing member positioned to contact the continuous web at a location opposite the print station as the print station applies ink to the first side of the continuous web.

15. The system of claim 14, the plurality of devices including a leveler roller positioned along the media path at a location that enables the leveler roller to contact the ink applied to the first side of the continuous web by the print station.

16. The system of claim 15, the leveler roller being opposite the image sensor to enable the light source of the image sensor to direct light onto the second side of the continuous web.

17. The system of claim 16, the leveler roller being configured to reduce a temperature of the continuous web passing over the leveler roller.

18. The system of claim 15, the leveler roller having a black surface.

* * * * *